US005931034A

United States Patent [19]

Fisher

[11] Patent Number: 5,931,034

[45] Date of Patent: Aug. 3, 1999

[54] VEHICLE DOOR LOCK ACTUATOR

[75] Inventor: Sidney Edward Fisher, Solihull, United Kingdom

[73] Assignee: Meritor Light Vehicle Systems (UK) Ltd., Birmingham, United Kingdom

[21] Appl. No.: 09/068,867

[22] PCT Filed: Sep. 20, 1996

[86] PCT No.: PCT/GB96/02294

§ 371 Date: Jul. 23, 1998

§ 102(e) Date: Jul. 23, 1998

[87] PCT Pub. No.: WO97/20121

PCT Pub. Date: Jun. 5, 1997

[30] Foreign Application Priority Data

Nov. 24, 1995 [GB] United Kingdom ..... 9524084

[51] Int. Cl.[6] ..... E05B 47/00

[52] U.S. Cl. ..... 70/264; 70/279.1; 292/201; 292/DIG. 27

[58] Field of Search ..... 70/277, 279.1, 70/264; 292/216, 201, 336.3, DIG. 27

[56] References Cited

U.S. PATENT DOCUMENTS

| | | | |
|---|---|---|---|
| 4,334,704 | 6/1982 | Yamada | 292/216 |
| 5,618,068 | 4/1997 | Mitsui et al. | 292/201 |

FOREIGN PATENT DOCUMENTS

| | | |
|---|---|---|
| 0 231 042 A2 | 8/1987 | European Pat. Off. . |
| 0 342 099 A1 | 11/1989 | European Pat. Off. . |
| 295 11 451 U1 | 9/1995 | Germany . |
| 2 228 525 | 8/1990 | United Kingdom . |
| 2 284 232 | 5/1995 | United Kingdom . |
| WO 95/18904 | 7/1995 | WIPO . |

*Primary Examiner*—Lloyd A. Gall
*Attorney, Agent, or Firm*—Woodcock Washburn Kurtz Mackiewicz & Norris LLP

[57] ABSTRACT

Remotely controlled power operable lock actuator mechanism for vehicle doors comprises a main power driven locking lever rocking between locked and unlocked conditions and a T-shaped output lever, one arm of which has a longitudinal slot. Co-axial with the output lever is a drive input lever operated by the interior door handle and having a slot with a lateral extension. A drive dog pin is received in both slots and can be shifted longitudinally thereof by a superlocking power actuator to disable drive connection between the levers by positioning the dog in the slot extension. An overriding link with lost motion connection between the dog and the main lever enables manual cancellation of superlocking if power fails.

5 Claims, 4 Drawing Sheets

VEHICLE DOOR LOCK ACTUATOR

This invention relates to lock actuator mechanism for doors and other closures of vehicles. It has particular but not exclusive application to actuator mechanisms forming part of locking systems of the kind in which the individual locks are power operable and interconnected through a central control unit for electrical actuation whereby locking or unlocking of all doors can be effected from a single control station operable from within or outside the vehicle, herein referred to as "central locking systems".

More specifically the invention relates to mechanism providing a superlocking facility whereby the latch of the door operatively associated with the particular mechanism cannot be freed from a locked condition even if access is gained to the interior door handle or other manual actuating elements within the vehicle, for example in attempting unauthorised intrusion by breaking a window or probing into or through the door.

It is known from DE-U-29511451 to provide power operable mechanism incorporating a superlocking facility which can be set or cancelled by remote operation, and including provision for key controlled manual override that the respective door can be opened to provide authorized access even if the power operation should malfunction or fail; the superlocking operating by shifting a coupling element transmitting down from an input to an output member of the mechanism to an inoperative position authorized overriding operating by automatically returning said element to its drive position independently of power actuation.

The object of the invention is to provide actuator mechanism having a remotely controllable powered or other superlocking facility which is convenient and reliable in operation, of simple and durable construction, which can readily be provided by modification of existing patterns of latch and locking assemblies, and which enables authorized access to the vehicle even if powered operation should break down or fail, for example if the vehicle has been left locked and parked and the battery has gone flat, by a particularly convenient and economical construction.

BRIEF DESCRIPTION OF THE DRAWINGS

An example of the invention is now more particularly described with reference to the accompanying drawings wherein.

DETAILED DESCRIPTION OF THE PREFERRED EMBODIMENT

Figure 1:
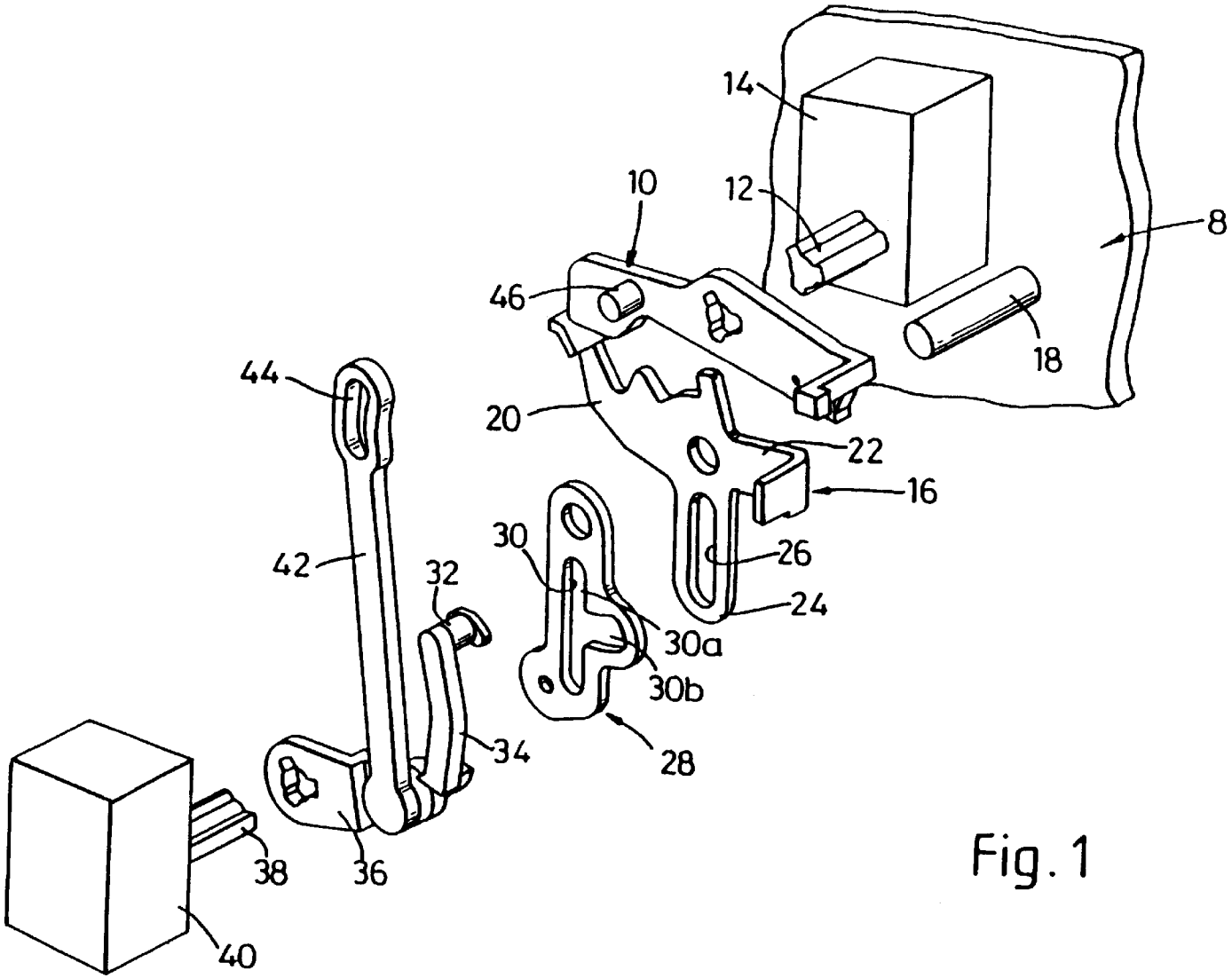
FIG. 1 is an exploded perspective view of components of a lock actuator mechanism.
Figure 2:
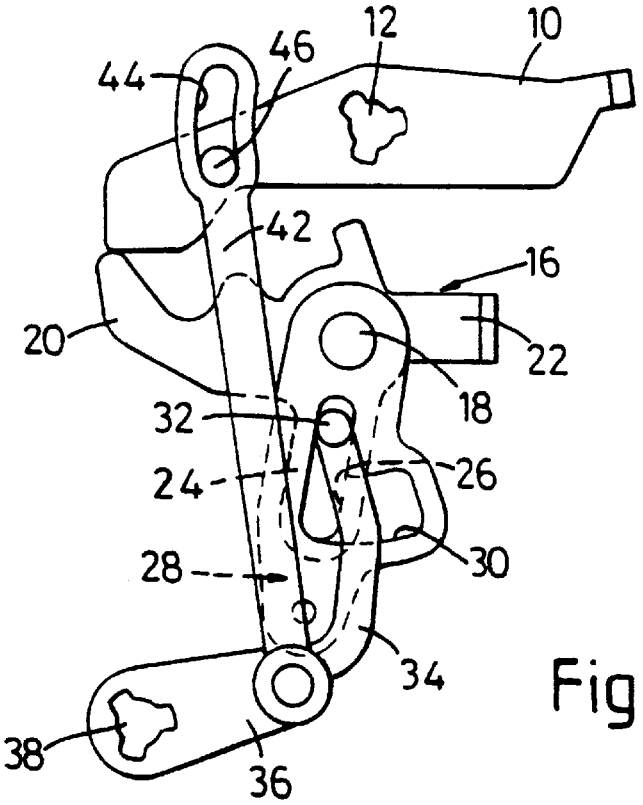
FIGS. 2–5 are elevations of said components in their assembled relationship and showing them in a sequence of different operating positions.
Figure 3:
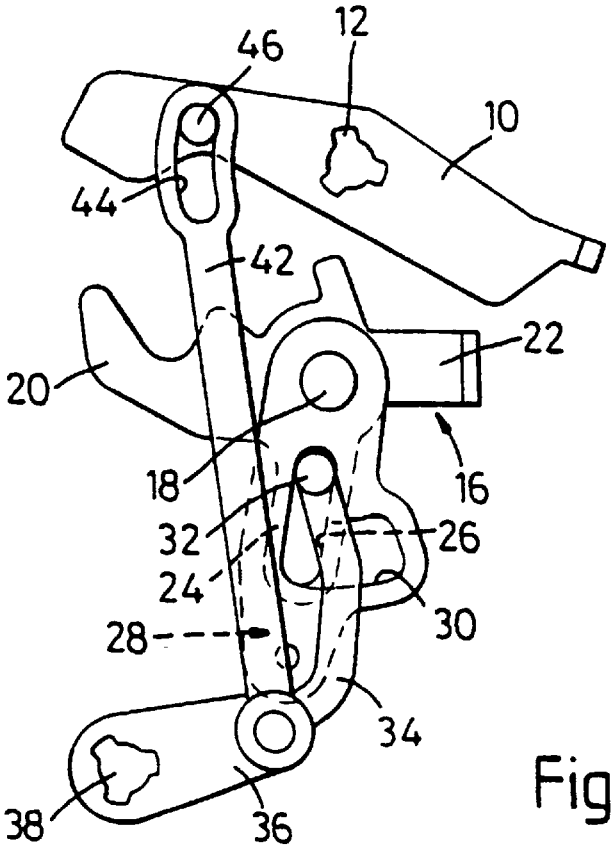

The mechanism described will be incorporated into a vehicle door latch and locking assembly of known kind having remotely controlled power operation as part of a central locking system of the vehicle. Only such parts of the latching cad locking mechanisms of the assembly as are necessary to the understanding of these examples of the invention are here described and shown in the drawings.

The assembly will include latching means (not shown) releasably retaining the door at the closed position, the latching means being released for opening the door by the operation of interior or exterior door handles (not shown).

Said assembly includes a mounting formation 8 (shown only in part in FIG. 1) locating its various components and constructed to form a housing substantially containing and protecting them both from ingress of dirt and from any unauthorised probing or other access with a view to tampering with the mechanism.

Referring now to FIGS. 1–5 of the drawings said assembly includes lock actuator mechanism having a main locking lever 10 secured on a drive shaft 12 of a main powered actuator 14 (FIG. 1) incorporating an electric drive motor. Actuator 14 is selectively operated from the central system to shift lever 10 angularly between a locked position shown in FIGS. 2 and 4 with its arms generally horizontal, and an unlocked position shown in FIGS. 3 and 5 rotated clockwise by about 30° from the locked position. Lever 10 is connected for actuation of the locking mechanism of the assembly in known manner.

A generally T-shaped drive output lever 16 is fulcrummed on a fixed pivot 18 spaced below locking lever 10 as viewed in the drawings and has a pair of generally horizontal arms 20, 22 and a third generally vertical arm 24 extending downwards from its fulcrum.

Arm 24 includes a longitudinal drive formation in the form of a parallel sided slot 26.

Fulcrummed co-axially with lever 16 on pivot 18 is a drive input lever 28 extending generally vertically from pivot 18 so that its major part is in face to face relationship with slotted arm 24. The distal end of lever 28 is connected to the interior door handle, actuation of the latter causing angular displacement of lever 28 through a linkage (not shown).

Lever 28 also includes a drive formation in the form of an L-shaped slot 30 having a vertical upper limb 30*a* co-incident with the upper part of slot 26 in arm 24 when levers 16 and 28 are at the same angular position, and a generally horizontal limb 30*b* forming a slot portion which extends laterally to the right as viewed in the drawings.

A headed pin forms a drive dog 32 which is engaged through both lever slots 26 and 30. Dog 32 is carried on the upper end of a superlocking link 34, its lower end being pivotally connected to the distal end of a superlocking lever 36. The proximal end of lever 36 is secured on a drive shaft 38 of a superlocking powered actuator 40 (FIG. 1) also incorporating an electric drive motor selectively operated from the central system for angular movement of lever 36 between an upper engaged position, shown in FIGS. 2, 3 and 5, and a lower lost motion superlocking position shown in FIG. 4.

In the latter position dog 32 is shifted downwardly to co-act with the lower portions of slots 26 and 30. In this position the horizontal limb 30*b* of slot 30 permits angular movement of drive input lever 28 without any motion being transmitted to output lever 16, thus rendering the interior door handle inoperative by disabling its drive connection to the latch mechanism.

This superlocked condition prevents the door being opened from the inside when the vehicle is otherwise locked. In this particular application there is no sill button or other manually operable element on the inside of the door for locking or unlocking the related assembly, this can only be effected from the inside by powered operation.

Normally powered operation will suffice for all operating conditions; the central locking system enables locking and unlocking of some or all of the vehicle doors from the outside, typically by a hand-held remote control device of known kind emitting a coded infra-red or ultrasonic signal to a pick-up on the vehicle body, the central system ensuring that all the doors and/or other closures are secured and superlocked with corresponding cancellation unlocking the mechanism when a door is to be opened.

Failure of the central locking system might occur, most commonly due to the vehicle being left parked and locked and the battery going flat (e.g. if lights have inadvertently been left switched on) or, more rarely, due to failure or malfunctioning of electrical components of the system. Hence provision is made for at least one door on the vehicle to be unlocked manually in such emergency, independently of its power actuation, from the vehicle exterior as by providing a conventional key-operated lock cylinder linked to the main locking lever 10, operation by the key displacing lever 10 from its locked to its unlocked position.

This emergency manual operation would not in itself remove the superlocking setting referred to above as actuator 40 will remain inoperative as well as actuator 14.

The mechanism further includes overriding means for manual cancelling of superlocking, linking main locking lever 10 to drive dog 32.

In the example illustrated in FIGS. 1–5 the overriding means comprises an overriding link 42 pivotally connected at a lower end to the lower end of superlocking link 34 by co-axial connection with the distal end of superlocking lever 36.

The upper end of link 42 has an arcuate slot 44 extending in a generally longitudinal direction and engaged by a pin 46 mounted near the end of the left hand arm of main lever 10.

Figure 4:
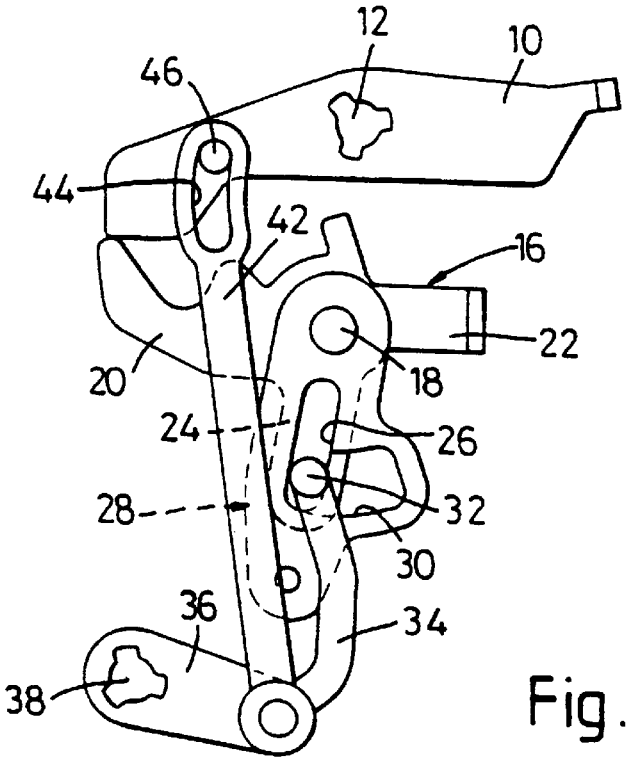
Figure 5:
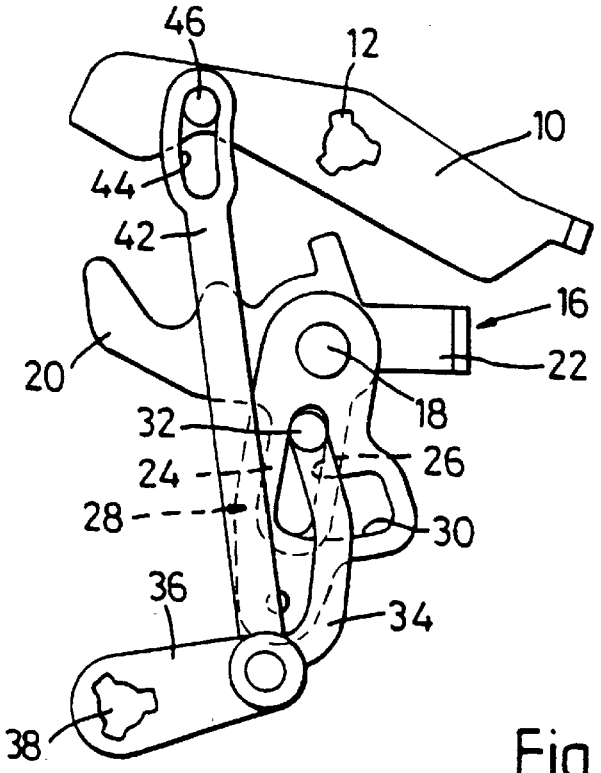

Slot 44 provides lost motion connection between lever 10 and link 42 so that drive dog 32 is not displaced from its engaged position (superlocking off) by locking and unlocking movement of lever 10. However, if dog 32 has been drawn down to its superlocking position as shown in FIG. 4 movement of lever 10 from the locked position there shown will draw overriding link 42 upwards and shift dog 32 to its engaged position as shown in FIG. 5, so connecting the drive between lever 28 and 16. Thus the superlocking is cancelled without any power drive input from actuator 40.

Figure 6:
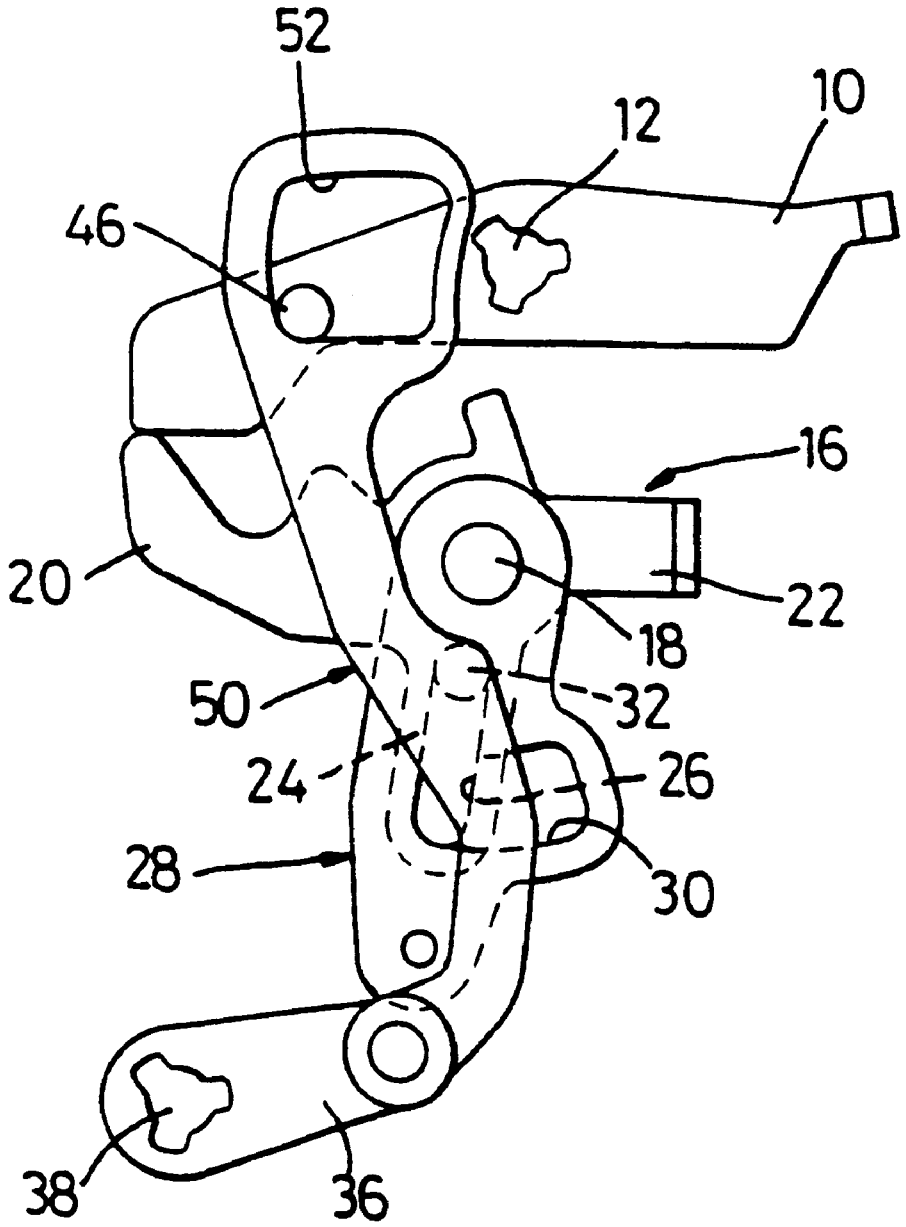
FIG. 6 is a like elevation of a modified form of said components.

FIG. 6 illustrates a modified construction in which the separate superlocking and overriding links 34 and 42 are replaced by a single dual purpose link 50 having a lower end pivotally connected to superlocking lever 36, carrying drive dog 32 on a median part, and having its upper end in co-acting relationship with pin 46 on lever 10. Said upper end defines a rectangular cut-out 52 in place of the more confined slot 44 of link 42 to allow the necessary side to side angular movement of link 50 giving the lateral freedom of relative movement of dog 32 in its superlocking condition.

In another modified construction the drive formation of input lever 28 may be a longitudinal slot with a lower portion of one side wall, to the right as viewed in the drawings, completely removed so that the lost motion on superlocking is provided by dog 32 being able to enter and leave that slot laterally while remaining captive in slot 26 of arm 24.

It will be understood that the drive formation which includes a portion shaped to permit relative lateral movement between the drive dog and the related lever arm could be provided in the arm of the output lever 16, while the arm of the input lever 28 has a simple longitudinal extending slot or other drive formation.

Instead of the separate main and superlocking power actuators with individual drive motors a single actuator having a dual drive output might be used, or a single drive output might be employed for sequential locking and superlocking as by shifting an element to a first position for locking and driving it on to a further position to shift the drive dog for superlocking.

I claim:

1. A vehicle door lock actuator mechanism including:

(a) a mounting formation;

(b) a driven input lever fulcrummed on said formation and having operative connection to an interior manually actuable element selectively operable to shift said input lever about its fulcrum axis between first and second angular positions;

(c) a driven output lever having operatives connection with latching means whereby displacement of the output lever from a first to a second angular position releases the door from a latched condition in use;

(d) a main locking element coupled to a main power drive element for selective powered displacement thereof between a locked condition at which an associated latch is secured against release and an unlocked position freeing the associated latch for release;

(e) exterior manually actuable but key controlled release means selectively operable to shift said main locking element to the unlocked condition without power input from said main power drive element;

(f) coupling means comprising a drive dog having connection with one of said driven input and output levers so that it is positively displaced on angular movement thereof and engaging a drive formation of the other of said driven input and output levers extending longitudinally of a lever arm thereof and having a portion shaped to permit relative movement between the drive dog and said arm laterally of the output lever;

(g) a superlocking drive element linked to the drive dog for selective powered displacement of the drive dog longitudinally of said lever arm and relative to both said driven input and output levers between an engaged position at which the drive dog couples the driven input and output levers for angular movement in unison, and a lost motion superlocking position at which the drive dog is aligned with said portion so that angular movement of the input lever between its first and second positions is not transmitted to the output lever for releasing the latch; and (h) overriding means linking the main locking element with the drive dog whereby if the drive dog has been set to the lost motion superlocking position it will be carried to the engaged position by movement of the main locking element from the locked to the unlocked condition independently of the superlocking drive element.

2. A mechanism as in claim 1 wherein the output lever is fulcrummed on the mounting formation co-axially with the input lever and an arm of the output lever is in substantially face to face relationship with an arm of the input lever when both levers are at the same angular position, the drive dog engaging drive formations extending longitudinally of both arms and being shifted therealong by the superlocking drive element.

3. A mechanism as in claim 1 wherein the overriding means includes a link coupled to an element carrying the drive dog or itself carrying the drive dog and having lost motion connection with a portion of the main locking element.

4. A mechanism as in claim 1 wherein the drive dog is carried on a link shifted by the superlocking drive element, said link also acting as the overriding means by being provided with a formation coacting with the main locking element.

5. A mechanism as in claim 1 wherein both the superlocking drive element and the main power drive element are powered by a common drive motor.

* * * * *

UNITED STATES PATENT AND TRADEMARK OFFICE

CERTIFICATE OF CORRECTION

PATENT NO. : 5,931,034

DATED : August 3, 1999

INVENTOR(S) : Sidney Edward Fisher

It is certified that error appears in the above-identified patent and that said Letters Patent is hereby corrected as shown below:

Column 1, line 63, "cad" should be --and--.

Signed and Sealed this

Fourteenth Day of March, 2000

*Attest:*

Q. TODD DICKINSON

*Attesting Officer*

*Commissioner of Patents and Trademarks*